US008500944B2

(12) United States Patent
Lawrence

(10) Patent No.: US 8,500,944 B2
(45) Date of Patent: Aug. 6, 2013

(54) CARRY HANDLE

(76) Inventor: Patricia Lawrence, San Francisco, CA (US)

( * ) Notice: Subject to any disclaimer, the term of this patent is extended or adjusted under 35 U.S.C. 154(b) by 0 days.

(21) Appl. No.: 13/219,474

(22) Filed: Aug. 26, 2011

(65) Prior Publication Data

US 2011/0308698 A1 Dec. 22, 2011

Related U.S. Application Data

(62) Division of application No. 11/811,049, filed on Jun. 7, 2007, now Pat. No. 8,032,986.

(51) Int. Cl.

| | |
|---|---|
| ***A41B 13/04*** | (2006.01) |
| ***B32B 3/00*** | (2006.01) |
| ***B32B 7/14*** | (2006.01) |
| ***B32B 37/00*** | (2006.01) |
| ***B65B 11/00*** | (2006.01) |
| ***B29C 65/00*** | (2006.01) |
| ***A45C 3/00*** | (2006.01) |
| ***A45C 7/00*** | (2006.01) |
| ***A45C 13/22*** | (2006.01) |
| ***A45C 13/26*** | (2006.01) |
| ***A45F 5/10*** | (2006.01) |
| ***A47J 45/00*** | (2006.01) |

(52) U.S. Cl.

USPC ..... 156/300; 156/70; 156/291; 16/407; 16/410

(58) Field of Classification Search

USPC ..... 156/60, 69, 70, 91, 92, 93, 182, 230, 156/239, 247, 249, 250, 252, 256, 263, 264, 156/265, 289, 290, 291, 293, 297, 299, 300; 16/110.1, 114.1, 405, 407, 410, 422, 425, 16/429, 902, 443, 444, 446; 53/413; 383/6, 383/11, 12, 14, 15, 21, 22, 23; 493/226; 229/117.09, 117.19, 117.22, 117.23, 117.24, 229/117.26; 220/752, 754, 757, 759, 760, 220/768, 769, 772, 773, 776

See application file for complete search history.

(56) References Cited

U.S. PATENT DOCUMENTS

| | | | | |
|---|---|---|---|---|
| 3,031,359 | A * | 4/1962 | Blank et al. | 229/117.26 |
| 4,286,714 | A * | 9/1981 | Zdarsky et al. | 206/526 |
| 6,701,571 | B2 * | 3/2004 | Hagen | 16/114.1 |

* cited by examiner

*Primary Examiner* — Philip Tucker
*Assistant Examiner* — Brian R Slawski
(74) *Attorney, Agent, or Firm* — Matlock Law Group; K. B. Matlock; Michael W. Caldwell

(57) ABSTRACT

A self contained disposable bonded carry handle comprised of a layer of bonding material having a bottom side and a top side being coated with a pressure sensitive adhesive, said top side being coated with pressure sensitive adhesive about the periphery, at least one flexible handle having a first end and a second end affixed to the pressure sensitive adhesive on the top side of the bonding layer such that the center portion of the handle is movable and foldable, a protective layer affixed to the adhesive layer on the top side of the bonding layer, said protective layer having an opening to allow for access to the handle, and a surface layer having a centralized hole and a bottom layer substantially coated with pressure sensitive adhesive, said bottom layer affixed to the protective layer such that the handle passes through the centralized hole.

5 Claims, 3 Drawing Sheets

CARRY HANDLE

CROSS-REFERENCE TO RELATED APPLICATIONS

This is a divisional application of and claims the benefit of priority under 35 U.S.C. §120 from U.S. application Ser. No. 11/811,049, filed on Jun. 7, 2007, now U.S. Pat. No. 8,032, 986.

FIELD OF THE INVENTION

The present invention relates generally to material packaging and more particularly to handles used for packaging. Specifically this invention relates to a carry handle that is applied to a package using a pressure sensitive adhesive to allow for ease of carrying the package.

Modernly packaging is handled by automated equipment and is therefore designed to present smooth surfaces to the automation equipment for reducing the possibility of the package getting damaged during shipment. Unfortunately this prevents package manufacturers from building convenient handles on their packaging. Conventionally, on well constructed packages, perforated cutouts are stamped into the cardboard material such that one may punch out the perforated cardboard section and use the resulting hole as a carrying handle. This works well for thick cardboard, but does not work well for lighter weight material. Also these perforated cutouts are at fixed locations on the package. These fixed locations may make it difficult for one carrying the package to reach. Further, cost of custom boxes with cut out handles is financially out of line for many companies and is not an option for the individual.

BACKGROUND

In many circumstances, carrying a package may be awkward. For example, the weight, size, gripping and access means may not be convenient when two arms are wrapped around a package and a person is attempting to open doors, find car keys, push an elevator button, or other similar activities requiring multiple hands in addition to carrying the package. It can even be dangerous. Struggling with over-sized packages pulls the body out of alignment and balance, increasing the possibility of bodily injury. Gripping and carrying a package with both arms around the package also prevents a person from having a free hand to reach to steady themselves if they are infirmed or if on an unsteady surface caused by wet or slippery conditions caused by rain, ice or roughness or while navigating stairs or steep inclines. Unwieldy packages can lead to the dropping of the package. Dropping may cause breakage creating loss of contents, those often being irreplaceable. There is a need to solve the above and other problems to better grip, carry and position packages.

As such, a convenient method to attach a carry handle to a package such that it presents a smooth surface to automation equipment and can be easily attached at convenient locations on the package is needed.

Further, current package handle devices and methods of carrying packages do not allow a plurality of lengths and configurations of handle devices nor provide a flexible method to carry packages of a plurality of shapes and sizes. Such a device in a tandem configuration or varying lengths is also needed. Consumers currently have no low cost, disposable, flexible handle solution available for a wide array of uses or placement on package. Further, there is no existing, low cost disposable device currently available durable enough to maintain a useful life for the life of the package and available for a wide array of uses or placement on packages. Finally, a flexible and durable device with a high performance adhesive capable of carrying loads up to 50 lbs is needed.

SUMMARY OF THE INVENTION

Disclosed herein is a carry handle comprised of a layer of bonding material having a bottom side and a top side said bottom side being coated with a pressure sensitive adhesive, said top side being coated with pressure sensitive adhesive about the periphery leaving the center of the top side of the bonding material free of pressure sensitive adhesive, at least one flexible handle having a first end and a second end affixed to the pressure sensitive adhesive on the top side of the bonding layer such that the center portion of the handle is movable and foldable, a protective layer of a resin Polyethylene Terephthalate (PET) often called polyester film, sheet, MYLAR, or other appropriate pliable material affixed to the adhesive layer on the top side of the bonding layer, said protective layer having an opening to allow for access to the handle, and a surface layer of a resin Polyethylene Terephthalate (PET) often called polyester film, sheet, MYLAR, or other appropriate pliable material having a centralized hole and a bottom surface substantially coated with pressure sensitive adhesive, said bottom surface affixes to the protective layer, once release liner is removed and discarded, such that the handle passes through the centralized hole.

The invention disclosed herein is directed to a device and method to apply the device to a plurality of packages that allows any person an improved way to handle, carry and transfer a wide range of packages.

In a preferred embodiment of the present disclosure, a device with a strap handle comprising a low rise from the surface of the package for use with one hand is described.

In another embodiment, the invention disclosure reveals a device with a strap handle, a long rise from the package surface that can be slung over the shoulder or around the waist, like a belt, and carried at the side leaving both hands free.

In yet another embodiment, the invention discloses a handle device either in a tandem arrangement or a single device applied in tandem on the surface of a package with a medium to long rise from the package surface such that the package can be carried either with two hands, or by two people or carried over two shoulders similar to a backpack.

The construction and method of operation of the invention, however, together with additional objectives and advantages thereof will be best understood from the following description of specific embodiments when read in connection with the accompanying drawings.

DETAILED DESCRIPTION OF THE DRAWINGS

Figure 1:
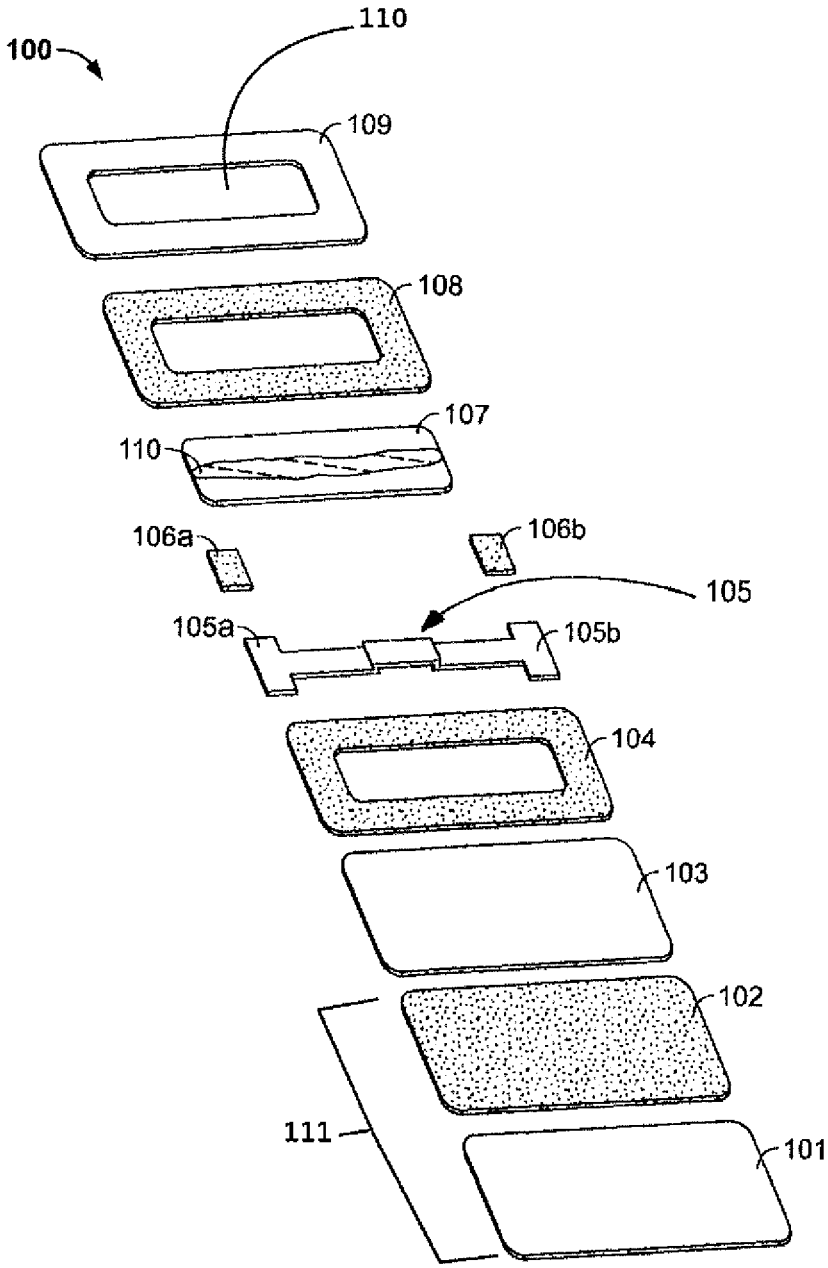
FIG. 1 shows a breakout drawing of one embodiment of the current invention.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 shows a breakout drawing one embodiment of the current invention 100. The bottom layer 111 of the current invention is a release liner comprised of paper, or other appropriate light and disposable material 101 used for covering a first pressure sensitive adhesive (PSA) layer 102. The release liner is designed to provide a nonstick surface over an adhesive and can be peeled away from the first PSA layer 102. The PSA layer 102 is affixed to a bottom side of a bonding material 103. The bonding material 103 is comprised of a pliable tear-resistant polymer, layer or a synthetic material made of high-density polyethylene such as TYVEK. However other tear-resistant materials may be used. The bonding material 103 in turn has a second PSA layer 104 affixed to a top side of the bonding material 103. The second PSA layer 104 is disposed on the top side of the bonding material 103 in a manner to cover the periphery of the top side of the bonding material 103 leaving the center of the bonding layer 103 free of PSA material.

A flexible handle 105 (shown folded) is comprised of a tear-resistant polymer, or a synthetic material made of high-density polyethylene such as TYVEK. However other tear-resistant materials may be used. The handle 105 is affixed to the second PSA layer at a first end 105*a* and a second end 105*b* such the handle may be unfolded in the center portion. A top of the first end 105*a* of the handle 105 has a portion of a third PSA layer 106*a* affixed over it and a top of the second end 105 has also has a portion of the third PSA layer 106*b* affixed over it. A protective material 107 is affixed atop the portions of the third PSA layer 106*a* and 106*b* as well as the exposed portion of the second PSA layer 104. The protective layer 107 is made from a resin Polyethylene Terephthalate (PET) often called polyester film, plastic sheet, MYLAR, or other appropriate pliable material. Thus the protective material 107 can be clear and the handle 105 can be visible to a user.

The protective material 107 is fabricated to provide an elongated opening for the handle 105 to pass through when is it unfolded. The top surface of the protective material 107 has a fourth PSA layer 108 disposed around the periphery to allow for the handle 105 to pass through when the handle 105 is unfolded. A surface layer 109 is affixed to the fourth PSA layer 108. The surface layer comprised of a tear-resistant polymer, or a synthetic material made of high-density polyethylene such as TYVEK is constructed with the center portion 110 removed to allow for the handle 105 to pass through when unfolded.

Figure 2A:
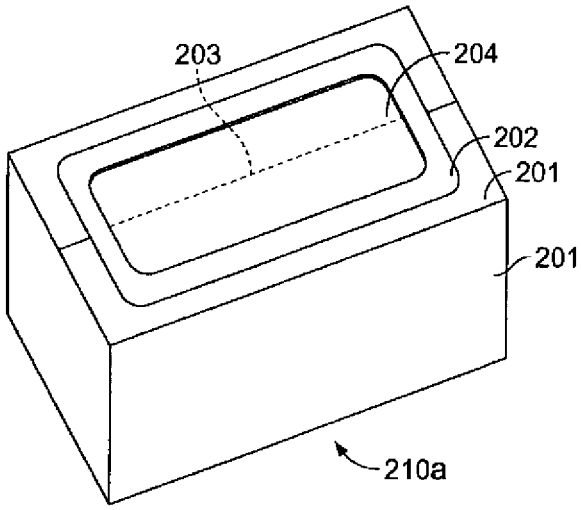
FIG. 2 shows the operation of the invention of FIG. 1.
Figure 2B:
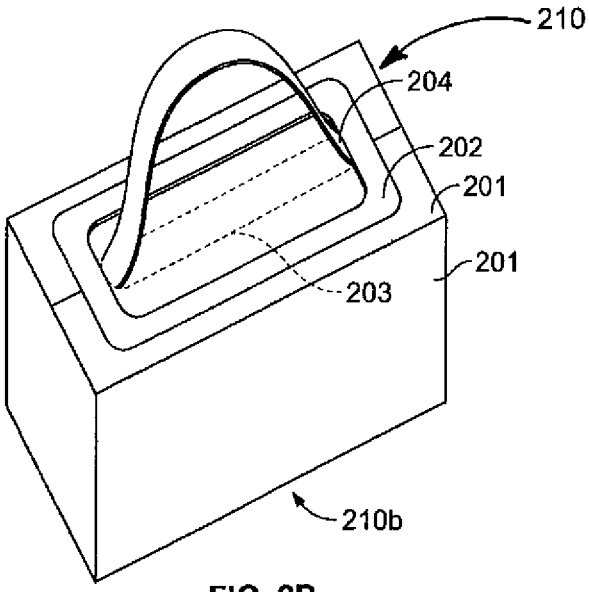

FIGS. 2A and 2B together show the operation of the invention of FIG. 1. In the FIG. 2A one embodiment of the current invention is affixed to a package 210*a* and 210*b* by removing the release liner comprised of paper, or light and disposable material 101 and exposing a PSA layer. The PSA layer is pressed against the package 210 affixing the current invention to the package 210*a* and 210*b*. The handle 204 is folded substantially flat and positioned under a protective layer 203. To use the handle 204, a user reaches through an access 202 in the protective layer 203. The access 202, 203 being constructed to substantially cover the handle 204 and to open sufficiently to allow the handle 204 to extend out of the access and unfold such that a user can grab the handle 204. In the FIG. 2B another aspect of the current invention is shown wherein the carrying handle is extended.

This device can be applied to a package prior to shipping. The enclosed handle can be extended, used for carrying the package, then reinserted into the attached covering, protecting the handle from catching on machinery or other objects during shipping, and then used on the recipient end by re-extending the handle from within the protective covering to carry the package to its final destination. This invention allows any person to apply the device to a wide variety of packages regardless of size and shape. They can then conveniently handle and carry that package with ease. Another advantage of this device is that it may be manufactured with varying handle lengths to allow for various methods for carrying the package.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 3:
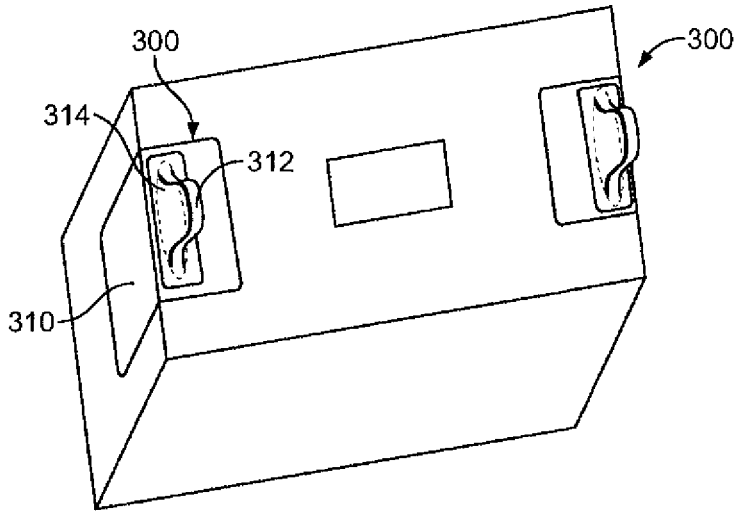
FIG. 3 shows another embodiment of the current invention for affixing on the corner of a package.

FIG. 3 shows another embodiment of the current invention 300 for affixing on both corners of a package. In this embodiment the invention is constructed similar to the embodiment of FIG. 1, however, the shape of the layers and position of the handle are disposed to allow for form fitting along the edge of a package. In this embodiment a handle 312 is shown unfolded from under a protective cover 314 said handle 312 disposed laterally along the edge of the package. This allows one person to use both hands, or two people to use one hand each to allow heavier weight. The identification marker 316 could be in the form of a bar code or an RFID chip that could be used in tracking. One having skill in the art would appreciate that differing shapes, positions and lengths of the invention are all within the scope and spirit of the current invention and disclosure.

Figure 4:
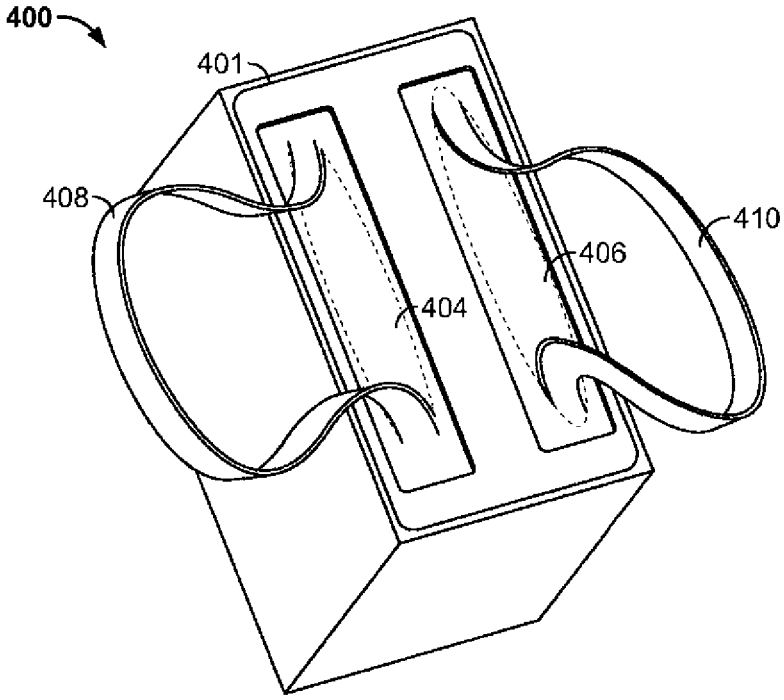
FIG. 4 shows yet another embodiment of the current invention having two handles.

FIG. 4 shows yet another embodiment of the current invention 400 having two handles. In this embodiment the invention is constructed similar to the embodiment of FIG. 1 with the exceptions described herein. A protective layer 401 is constructed with a first access 404 and a second access 406. Disposed beneath the first access 404 is a first handle 408. The first handle 408 is constructed to fold beneath the protective layer 401 and may extend through the access 404 by unfolding. Disposed beneath the second access 406 is a second handle 410. The second handle 410 is constructed to fold beneath the protective layer 401 and may extend through the second access 406 by unfolding. In this embodiment the invention may attach to a large package for handling by two people, or a person may wrap the first handle 408 and the second handle 410 around their shoulders, like a backpack, to facilitate carrying the package.

In another aspect of the present invention, the device may be designed with a high performance bonding ingredient to accommodate package loads of up to 50 lbs wherein said bonding ingredient is selected from a group consisting of adhesives, tape, or glue.

In another aspect of the present invention, the device will contain a release liner 101 that covers the bonding ingredient to preserve the bonding qualities during the useful life of the package itself to promote device durability. Further, said release liner further protects said bonding ingredient from compromise prior to its application to the package itself.

In another aspect of the present invention, the extendable handle 204 will be self contained in an embodiment of the protective covering 203 that overlaps including either re-sealable adhesive, hook and loop bonding material, or an overlapped closure, comprising the outer panels of said device wherein said device is folded in a plurality of directions to present said outer panel to the interior cavity of said device upon its bonding to exterior surface of said package. First, the extendable handle is the only thing that can be self enclosed in the protective covering with the methods of securing the opening closed, as listed here, for additional security.

The devise can be enclosed entirely in packaging for individual sale or distribution and additional embodiments of the devise can include on the protective layer itself additional means to secure the opening closed.

In another aspect of the present invention, an identification marker could be placed on either the handle itself or on the body of the base. This could be in the form of a Bar code or an RFID chip that could be used in tracking. The embedded chip could also be activated emitting a beacon when the handle is pulled for use. The chip could be either a passive or active function depending on the use of the device. It could also be used as an emergency beacon, in other embodiments. Those skilled in the art will recognize suitable means to implement these and other embodiments.

One having skill in the art would appreciate that differing shapes, positions and lengths of the invention are all within the scope and spirit of the current invention and disclosure. Different numbers of handles as well as lengths of handles may be incorporated in keeping with the spirit of the current invention and the invention may be constructed of different materials to provide for different package materials, shapes and weights.

In yet another embodiment of the invention, the protective covering will permit the device to be extended for use prior to shipping, reinserted securely inside the protective covering and re-extended upon delivery for ease of carrying.

In other embodiments the materials used allow for customization of the handle through printing or other embellishment. The customization could include logos, trademarks, motos, slogans, identifying colors, shipping or handling instructions, sender's/recipient's address and any number of other configurations.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A method of manufacturing a carry handle comprising the following steps in any order:

coating a bottom surface of a tear-resistant non-tubular bonding material with a pressure sensitive adhesive;

coating a top surface of the non-tubular bonding material about the periphery such that a central portion of the top surface of the non-tubular bonding material is not coated;

adhering a first end of at least one tear-resistant flexible handle and a second end of the tear-resistant flexible handle to the top surface of the non-tubular bonding material;

adhering a bottom surface of a protective layer to the top surface of the handle and to the remaining exposed top surface of the non-tubular bonding material, said protective layer covering the handle, having a hole for allowing the handle to pass through, and presenting a smooth surface when the handle is covered; and adhering a surface layer to the top surface of the protective layer, said surface layer have a centralized hole for providing access to the handle, wherein the flexible handle is positioned under said protective layer when the handle is folded substantially flat, and wherein the flexible handle is accessible by reaching through the hole in the surface layer and the hole in the protective layer such that the handle may be extended.

2. The method of claim 1 further comprising adhering a layer of release liner comprised of paper, or other appropriate light and disposable material to the bottom side of the non-tubular bonding material such that the pressure sensitive adhesive on the bottom side of the bonding layer is exposed when the release paper is removed.

3. The method of claim 1 wherein the non-tubular bonding material is constructed using a pliable tear-resistant polymer layer, a synthetic material made of high-density polyethylene.

4. The method of claim 1 wherein the surface layer is constructed from a resin Polyethylene Terephthalate (PET) often called polyester film, sheet, or other appropriate pliable material.

5. The method of claim 1 wherein the protective layer is flexible.

* * * * *